United States Patent [19]

Bus et al.

[11] Patent Number: 4,559,113

[45] Date of Patent: Dec. 17, 1985

[54] METHOD AND APPARATUS FOR UNILATERAL ELECTROPLATING OF A MOVING METAL STRIP

[75] Inventors: Isaäk Bus, Ijmuiden; Joop N. Mooij, Castricum, both of Netherlands

[73] Assignee: Hoogovens Groep B.V., Ijmuiden, Netherlands

[21] Appl. No.: 590,226

[22] Filed: Mar. 16, 1984

[30] Foreign Application Priority Data

Mar. 16, 1983 [NL] Netherlands ..... 8300946

[51] Int. Cl.[4] ..... C25D 5/02; C25D 17/00

[52] U.S. Cl. ..... 204/15; 204/206

[58] Field of Search ..... 204/15, 206, 13

[56] References Cited

U.S. PATENT DOCUMENTS

| | | | |
|---|---|---|---|
| 3,443,996 | 5/1969 | Falk | 204/206 |
| 3,483,113 | 12/1969 | Carter | 204/206 |
| 3,900,383 | 8/1975 | Austen | 204/211 |
| 4,053,370 | 10/1977 | Yamashita | 204/13 |
| 4,076,597 | 2/1978 | Subramanyan | 204/13 |

FOREIGN PATENT DOCUMENTS

| | | | |
|---|---|---|---|
| 53-5035 | 1/1978 | Japan | 204/13 |
| 53-17536 | 6/1978 | Japan | 204/13 |

*Primary Examiner*—T. M. Tufariello

*Attorney, Agent, or Firm*—Stevens, Davis, Miller & Mosher

[57] ABSTRACT

In a so-called radial cell for unilateral electroplating of a moving metal strip, the strip as the cathode is in contact with an electrically conductive peripheral surface of a rotating cathode roller. An anode concentric with the roller over a part of the roller circumference is located at a distance from the strip so as to form a slot into which electrolyte is supplied. It has been found that the electrolytic process is improved in uniformity and speed if the electrolyte is supplied only at the entrance end of the slot in the direction of strip movement so that the electrolyte flows turbulently and generally unidirectionally through the slot to the exit end thereof and at a rate such that the average velocity of the electrolyte through the slot is at least 75% of the linear strip velocity. The angular length of the slot can be less than 180°. Preferably the average velocity of the electrolyte through the slot is at least equal to the linear strip velocity.

5 Claims, 1 Drawing Figure

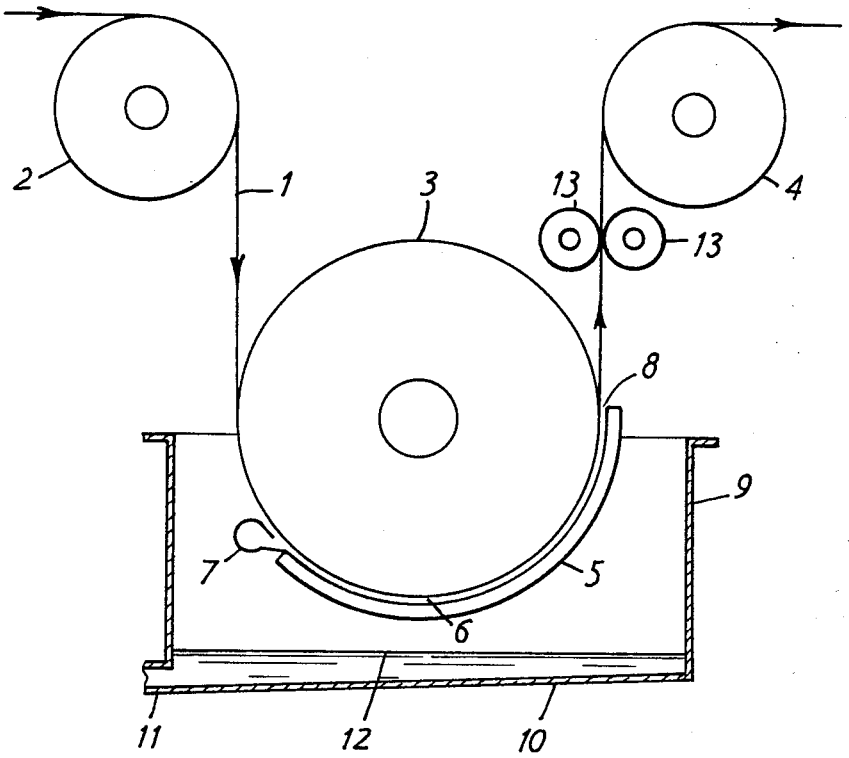
2
1
3
13
13
4
8
9
7
5
6
11
12
10

METHOD AND APPARATUS FOR UNILATERAL ELECTROPLATING OF A MOVING METAL STRIP

BACKGROUND OF THE INVENTION

1. Field of the Invention

This invention relates to a method of unilateral electroplating of a moving metal strip in which the strip as the cathode is in contact with an electrically conductive peripheral surface of a rotating roller and an anode concentric with the roller over a part of its circumference is located at a distance from the strip so as to form a slot into which electrolyte is supplied. The invention also relates to apparatus for carrying out the method.

2. Description of the Prior Art

Cells for electroplating continuous moving metal strip have been classified into three types, horizontal, vertical and radial. The present invention relates to the radial type. In the horizontal and vertical types, the strip passes without contact between a pair of spaced electrodes. Disadvantages are that the strip must be tensioned to hold it in the desired path through the cell and that the current must be fed along the strip which, especially with thin strip, creates resistance losses. These disadvantages are avoided by the radial type of cell where current is fed into the strip directly from the roller which it contacts in the cell, and tension needs to be applied only to hold the strip against the roller which accurately locates the strip. Only unilateral coating of the strip is possible, but two such cells can be arranged in series in the direction of strip movement. The strip width is, for example, 1.5 m.

U.S. Pat. Nos. 3,900,383 and 3,483,113 show examples of radial type cells. In the apparatus of U.S. Pat. No. 3,900,383, the roller is half-immersed in a bath of electrolyte. In that of U.S. Pat. No. 3,483,113, FIG. 20, the anode extends around 270° of the horizontal-axis roller and electrolyte is fed in opposite the lowest part of the roller so as to pass through the slot between anode and strip in two flows, one in the same direction as the strip movement and the other in the opposite direction to the strip movement.

SUMMARY OF THE INVENTION

We have now discovered that improvement of the electrolytic process can be achieved, permitting high current density at low voltage and therefore a compact cell. Furthermore a highly even and very thin electroplated layer can be applied to the moving strip, e.g. in the case of very thin steel strip on which chromium is plated.

In the invention, the electrolyte is supplied only at the entrance end of the said slot (i.e. the entrance end in respect of the direction of strip movement) in such a manner that the electrolyte flows turbulently and generally unidirectionally through the slot to the exit end thereof and at a rate such the average electrolyte velocity through the slot is at least 75%, preferably at least 100%, of the linear strip velocity.

It is thought that this turbulent flow of the electrolyte at high speed in the slot in the same direction as the strip improves electrochemical process by improving the transport of ions. In particular, the flow breaks up the boundary layer at the anode thereby reducing the voltage across the cell, resulting in substantial cost saving bearing in mind the large current involved. The uniform nature of the process is thought to cause uniform deposition of the layer on the strip, permitting high-quality production, even at high strip speeds, even up to 600 m/min. Lower speeds, e.g. 300–600 m/min or even as low as 30 m/min may be appropriately used depending on the application.

The high deposition rate obtainable allows the circumferential length of the anode to be less than 180°, which simplifies the construction of the cell.

The invention also provides apparatus for carrying out this method, comprising a rotatable cathode roller having an electrically conductive periphery which, in use, is contacted by the strip so that the strip forms the cathode and an anode having a surface concentric with the cathode roller and extending at a predetermined distance from said periphery over a part of the circumference of the cathode roller so as to form a slot therebetween in which, in use, the electrolysis takes place, there being means for feeding liquid electrolyte under pressure into said slot. The apparatus is characterized in that said electrolyte feed means is adapted and located so as to discharge the electrolyte into the slot only at the end of the slot at which the moving strip enters and in such a manner that the electrolyte flows turbulently and generally unidirectionally along the slot to the other end thereof.

DESCRIPTION OF THE DRAWINGS AND OF THE PREFERRED EMBODIMENT

A preferred embodiment of the invention will now be described by way of non-limitative example, with reference to the accompanying diagrammatic drawing, which is a side view of apparatus embodying the invention.

In the apparatus illustrated, the steel strip 1 passes continuously round a first rotating guide roller 2, a larger cathode roller 3 having a conductive surface and a second rotating guide roller 4. The strip 1 is under slight tension, so that it makes good contact with the roller 3 over about 180°. Over about 135° of the lower half of the roller 3 there extends an anode 5 in the form of a part-cylinder concentric with the roller 3 and slightly spaced therefrom so as to provide a narrow slot 6 (12 mm wide, in this embodiment) between the anode 5 and the strip 1 contacting the cathode roller 3.

Electrolyte is fed into the whole axial length of the slot 6 from a pipe 7 extending parallel to the axis of the roller 3 through a slot in the pipe 7 arranged to direct the electrolyte under pressure as a jet. The pipe 7 is located at the circumferential end of the slot 6 at which the strip 1 enters the slot. Thus the electrolyte travels the whole circumferential length of the slot in the same direction as the strip 1 and exits at the strip exit end 8 of the slot 6 and is collected in a tank 9 having a sloping bottom 10 and an outlet 11 from which the electrolyte is pumped back into the pipe 7.

The liquid level in the tank 9 is shown at 12. To remove any liquid adhering to the strip 1, a pair of wringing rollers 13 are arranged above the exit end 8 of the slot 6, opposed to each other with the strip 1 between them.

As discussed above, the liquid electrolyte is fed in at the entrance end of the slot 6 at such a pressure and speed that it flows turbulently (i.e. non-laminarly) in the slot 6, and at an overall average velocity from the entrance end to the exit end 8 which is at least $\frac{3}{4}$ of the linear velocity of the strip through the electroplating apparatus.

There is thus formed an electrolytic cell for plating the strip 1. The anode 5 is non-consumable and the ions to be plated are provided by the electrolyte. The strip 1 acts as the cathode, current passing through it into the electrolyte directly from the cathode roller 3. The narrow width of the slot 6, together with the turbulent unidirectional electrolyte flow through the slot 6, creates a low-resistance cell which can operate at a large current while depositing a high-quality metal coating uniformly on the surface of the strip. A current density of $4A/cm^2$ can be achieved.

Since the anode 5 extends over less than half the circumference of the roller 3, assembly of the apparatus and replacement of the anode 5 or the roller 3 are simple operations.

Further details of the construction of the apparatus and the electricity supply arrangements need not be given, since these are conventional in this art or will present no problem to an expert.

The invention is for example advantageous in (a) the electroplating of chromium onto ultra-thin steel strip (strip thickness $<0.17$ mm, Cr layer 12 nm thick corresponding to 100 $mg/m^2$) and (b) the galvanising of thicker steel strip such as is used extensively in the automotive industry (strip thickness 0.7 mm for example, Zn layer 15 $\mu m$ thick corresponding to 105 $g/m^2$).

What is claimed is:

1. In a method of unilateral electroplating of a moving metal strip wherein the strip as the cathode is in contact with an electrically conductive peripheral surface of a rotating cathode roller within a container containing electrolyte and an anode concentric with the roller over a part of the roller circumference is located at a distance from the strip so as to form a slot into which electrolyte is supplied, the improvement comprising supplying the electrolyte only at the entrance end of said slot in the direction of strip movement and spaced above electrolyte contained in said container so that the electrolyte flows turbulently and generally unidirectionally through a 12 mm slot to the exit end thereof and at a rate such that the average velocity of the electrolyte through the slot is at least 75% of the linear strip velocity and prevents formation of the boundary layer on the anode thereby reducing the voltage across the cell.

2. A method according to claim 1 wherein the angular length of the slot is not more than 180°.

3. A method according to one of claims 1 and 2 wherein the said average velocity of the electrolyte through the slot is at least equal to the linear strip velocity.

4. Apparatus for the unilateral electroplating of a moving metal strip comprising a rotatable cathode roller having an electrically conductive periphery which, in use, is contacted by the strip so that the strip forms the cathode, an anode having a surface concentric with the cathode roller and extending at a predetermined distance from said periphery over a part of the circumference of the cathode roller so as to form a 12 mm slot therebetween in which, in use, the electrolysis takes place, and means for feeding liquid electrolyte under pressure into said slot only at the entry end of the slot for the moving strip and in such a manner that the electrolyte flows turbulently and generally unidirectionally along the slot to the other end thereof.

5. Apparatus according to claim 4 wherein the said anode surface extends over not more than 180°.

* * * * *